US006709294B1

(12) United States Patent
Cohen et al.

(10) Patent No.: US 6,709,294 B1
(45) Date of Patent: Mar. 23, 2004

(54) ELECTRICAL CONNECTOR WITH CONDUCTIVE PLASTIC FEATURES

(75) Inventors: Thomas S. Cohen, New Boston, NH (US); Robert A. Richard, New Boston, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/320,886

(22) Filed: Dec. 17, 2002

(51) Int. Cl.[7] ..... H01R 13/648

(52) U.S. Cl. ..... 439/608; 439/620; 333/184; 333/185

(58) Field of Search ..... 439/608, 620; 333/181, 182, 183, 184, 185

(56) References Cited

U.S. PATENT DOCUMENTS 4,195,272 A * 3/1980 Boutros ..... 333/182
4,276,523 A * 6/1981 Boutros et al. ..... 333/182
4,682,129 A * 7/1987 Bakermans et al. ..... 333/184
4,761,147 A * 8/1988 Gauthier ..... 439/607
5,551,893 A * 9/1996 Johnson ..... 439/620
6,174,203 B1 * 1/2001 Asao ..... 439/620
6,364,711 B1 * 4/2002 Berg et al. ..... 439/620

* cited by examiner

*Primary Examiner*—Tho D. Ta
(74) *Attorney, Agent, or Firm*—David H. Hwang; Teradyne Legal Dept.

(57) ABSTRACT

An electrical connector having electrical conductors in a plurality of rows is provided, wherein each of the plurality of rows includes a housing and a plurality of electrical conductors. Each electrical conductor has a first contact end connectable to a printed circuit board, a second contact end and an intermediate portion therebetween that is disposed within the housing. The housing includes a first region surrounding each of the plurality of electrical conductors, the first region made of insulative material and extending substantially along the length of the intermediate portion of the electrical conductors. The housing also includes a second region adjacent the first region and extending substantially along the length of the intermediate portion of the electrical conductors. The second region is made of a material with a binder containing conductive fillers.

22 Claims, 9 Drawing Sheets

ELECTRICAL CONNECTOR WITH CONDUCTIVE PLASTIC FEATURES

CROSS-REFERENCES TO RELATED APPLICATIONS

Not Applicable.

STATEMENT REGARDING FEDERALLY SPONSORED RESEARCH OR DEVELOPMENT

Not Applicable.

Reference to Microfiche Appendix

Not Applicable

BACKGROUND OF THE INVENTION

1. Field of the Invention

This invention relates generally to electrical connectors and more specifically to high speed electrical connectors.

2. Description of Related Art

Electrical connectors are widely used in the manufacture of electronic systems because they allow the system to be built in separate pieces that can then be assembled. Board-to-board connectors are widely used because sophisticated electronic systems are usually fabricated on multiple printed circuit boards. To assemble the electronic system, the printed circuit boards are electrically connected.

In the description that follows, the invention will be illustrated as applied to a board to board connector. In particular, the invention will be illustrated in connection with a backplane-daughter card interconnection system. Many electronic systems, such as computer servers or telecommunications switches are built using a backplane and multiple "daughter" cards. In such a configuration, the active circuitry of the electronic system is built on the daughter cards. For example, a processor might be built on one daughter card. A memory bank might be built on a different daughter card. The backplane provides signal paths that route electrical signals between the daughter cards.

Generally, electrical connectors are mounted to both the backplane and the daughter card. These connectors mate to allow electrical signals to pass between the daughter card and the backplane.

Because the electronic systems that use a backplane-daughter card configuration usually process much data, there is a need for the electrical connectors to carry much data. Furthermore, this data is generally transmitted at a high data rate. There is simultaneously a need to make the systems as small as possible. As a result, there is a need to have electrical connectors that can carry many high speed signals in a relatively small space. There is thus a need for high speed-high density connectors.

Several commercially available high-speed, high density electrical connectors are known. For example, U.S. Pat. No. 6,299,483 to Cohen et al. entitled High Speed High Density Electrical Connector is one example. Teradyne, Inc., the assignee of that patent, sells a commercial product called VHDM®. Another example may be found in U.S. Pat. No. 6,409,543 to Astbury, et al. entitled Connector Molding Method and Shielded Waferized Connector Made Therefrom. Teradyne, Inc., the assignee of that patent, sells a commercial product called GbX™. The foregoing patents arc hereby incorporated by reference.

Both of the above-described electrical connectors employ insert molding construction techniques, at least for the daughter card connectors. Subassemblies, called wafers, are formed around individual columns of signal contacts. The wafers are formed by molding a dielectric material around the metal signal contacts. The wafers are then stacked side by side to make a connector of the desired length.

One of the difficulties that results when a high density, high speed connector is made in this fashion is that the electrical conductors can be so close that there can be electrical interference between adjacent or nearby signal conductors. To reduce interference, and to otherwise provide desirable electrical properties, metal members are often placed between or around adjacent signal conductors. The metal acts as a shield to prevent signals carried on one conductor from creating "cross talk" on another conductor. The metal also impacts the impedance of each conductor, which can further contribute to desirable electrical properties.

Generally, the metal members are made from separate pieces of metal that are added to the connector. However, it has also been suggested that a metal coating be applied to the connector. Also, in some connectors, the base material of the housing is formed of metal, usually as a die cast part. Then, insulative members are inserted to preclude the signal conductors of the connector from being shorted by the metal housing.

A drawback of forming the shields from separate pieces of metal is that additional pieces are required to assemble the connector. The additional pieces increase the cost and complexity of manufacturing the connector. In some cases, shield pieces are stamped and formed to create tabs or projections that extend between adjacent signal conductors. This configuration reduces the number of separate pieces because the projections stay attached to the sheet, so only one additional piece is required. However, a drawback of forming a sheet with projections extending from it is that forming the projection leaves a hole in the sheet. Thus, while the projection increases shielding between signal conductors that are adjacent along a line running in one direction, leaving a hole in the shield sheet decreases shielding between signal conductors that are adjacent along a line running in an orthogonal direction. A further drawback of stamping and forming projections from a single shield member is that it is difficult to form projections that have bends or corners—which are often needed to follow contours of signal contacts in some connectors, such as right angle connectors.

A drawback of coating metal onto a plastic is that there are no combinations of readily available and inexpensive metals and plastics that can be used. Either the metal does not adhere well to the plastic or the plastic lacks the desired thermal or mechanical properties needed to make a suitable connector. A further drawback of coating metal onto plastic is that available plating techniques are not selective. The portions of the connector housing which should not be conductive must be masked before the coating is applied. For example holes in the housing that hold signal contacts are often filled with plugs before coating, which are then removed after coating. A drawback of manufacturing connectors using a die cast metal housing is the complexity arising from the use of insulative inserts. Further, there is a limit to how thin features on a die cast part can be made. Generally, a die cast housing will have thicker parts. Using thicker housing parts is generally undesirable because it reduces the overall density of the connector. Die cast metals are more expensive than typical plastic parts.

It would be highly desirable to provide a connector with desirable electrical properties that is easy to manufacture and provides a high signal density.

BRIEF SUMMARY OF THE INVENTION

With the foregoing background in mind, it is an object of the invention to provide a high speed, high density electrical connector that is easy to manufacture.

The foregoing and other objects are achieved in an electrical connector that is molded from different types of material to form at least two regions of distinct electrical properties. One region is formed from material filled with conducting material to alter the electrical properties.

In a preferred embodiment, an electrical connector having electrical conductors in a plurality of rows is provided, wherein each of the plurality of rows includes a housing and a plurality of electrical conductors. Each electrical conductor has a first contact end connectable to a printed circuit board, a second contact end and an intermediate portion therebetween that is disposed within the housing. The housing includes a first region surrounding each of the plurality of electrical conductors, the first region made of insulative material and extending substantially along the length of the intermediate portion of the electrical conductors. The housing also includes a second region adjacent the first region and extending substantially along the length of the intermediate portion of the electrical conductors. The second region is made of a material with a binder containing conductive fillers.

BRIEF DESCRIPTION OF THE DRAWINGS

Additional objects, advantages, and novel features of the invention will become apparent from a consideration of the ensuing description and drawings, in which—

DETAILED DESCRIPTION OF THE PREFERRED EMBODIMENT

Figure 1:
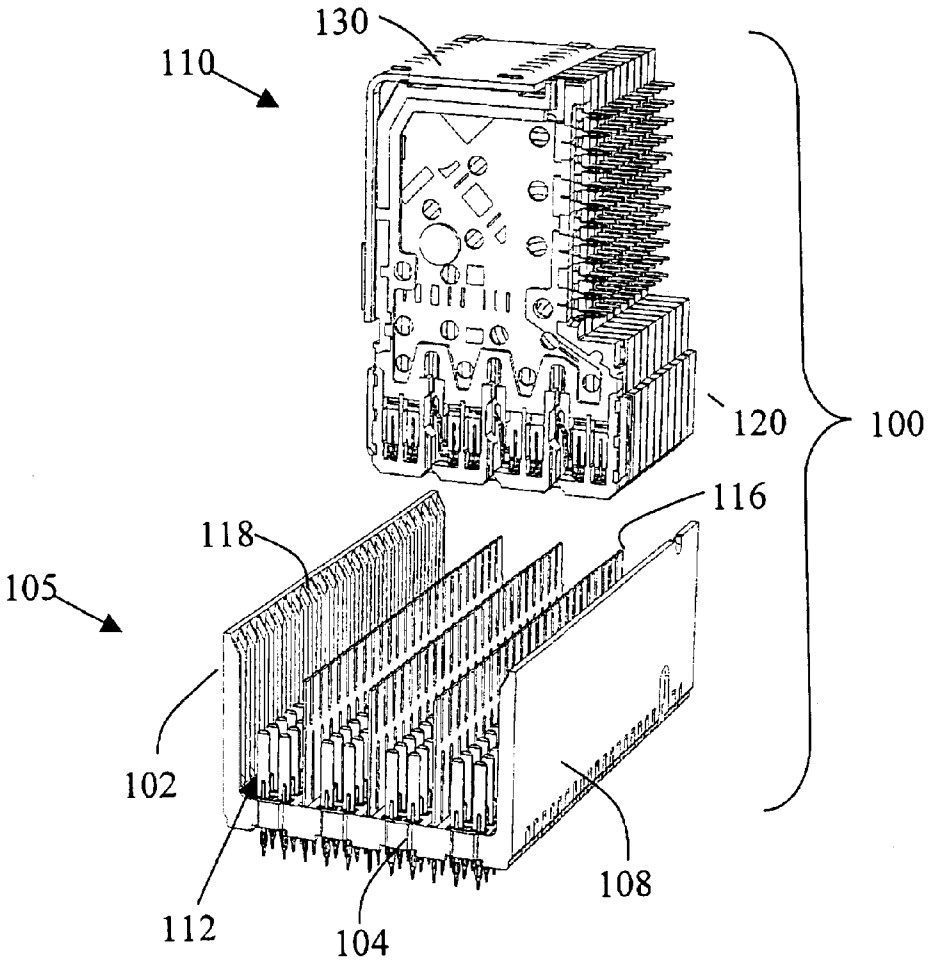
FIG. 1 (prior art)
FIG. 1 is a sketch of an electrical connector as known in the prior art.

Referring to FIG. 1, a two piece electrical connector 100 is shown to include a backplane connector 105 and a daughtercard connector 110. The backplane connector 105 includes a backplane shroud 102 and a plurality of signal contacts 112, here arranged in an array of differential signal pairs. In the illustrated embodiment, the signal contacts are grouped in pairs, such as might be suitable for manufacturing a differential signal electrical connector. A single-ended configuration of the signal contacts 112 is also contemplated in which the signal conductors are evenly spaced. In the prior art embodiment illustrated, the backplane shroud 102 is molded from a dielectric material. Examples of such materials are liquid crystal polymer (LCP), polyphenyline sulfide (PPS), high temperature nylon or polypropylene (PPO). All of these are suitable for use as binder materials in manufacturing connectors according to the invention.

The signal contacts 112 extend through a floor 104 of the backplane shroud 102 providing a contact area both above and below the floor 104 of the shroud 102. Here, the contact area of the signal contacts 112 above the shroud floor 104 are adapted to mate to signal contacts in daugthercard connector 110. In the illustrated embodiment, the mating contact area is in the form of a blade contact.

A tail portion of the signal contact 112 extends below the shroud floor 104 and is adapted to mating to a printed circuit board. Here, the tail portion is in the form of a press fit, "eye of the needle" compliant contact. However, other configurations are also suitable such as surface mount elements, spring contacts, solderable pins, etc. In a typical configuration, the backplane connector 105 mates with the daughtercard connector 110 at the blade contacts and connects with signal traces in a backplane (not shown) through the tail portions which are pressed into plated through holes in the backplane.

The backplane shroud 102 further includes side walls 108 which extend along the length of opposing sides of the backplane shroud 102. The side walls 108 include grooves 118 which run vertically along an inner surface of the side walls 108. Grooves 118 serve to guide the daughter card connector 110 into the appropriate position in shroud 102. Running parallel with the side walls 108 are a plurality of shield plates 116, located here between rows of pairs of signal contacts 112. In a presently preferred single ended configuration, the plurality of shield plates 116 would be located between rows of signal contacts 112. However, other shielding configurations could be formed, including having the shield plates 116 running between the walls of the shrouds, transverse to the direction illustrated. In the prior art, the shield plates are stamped from a sheet of metal.

Each shield plate 116 includes one or more tail portions, which extend through the shroud base 104. As with the tails of the signal contacts, the illustrated embodiment has tail portions formed as an "eye of the needle" compliant contact which is press fit into the backplane. However, other configurations are also suitable such as surface mount elements, spring contacts, solderable pins, etc.

The daughtercard connector 110 is shown to include a plurality of modules or wafers 120 that are supported by a stiffener 130. Each wafer 120 includes features which are inserted into apertures (not numbered) in the stiffener to locate each wafer 120 with respect to another and further to prevent rotation of the wafer 120.

Figure 2:
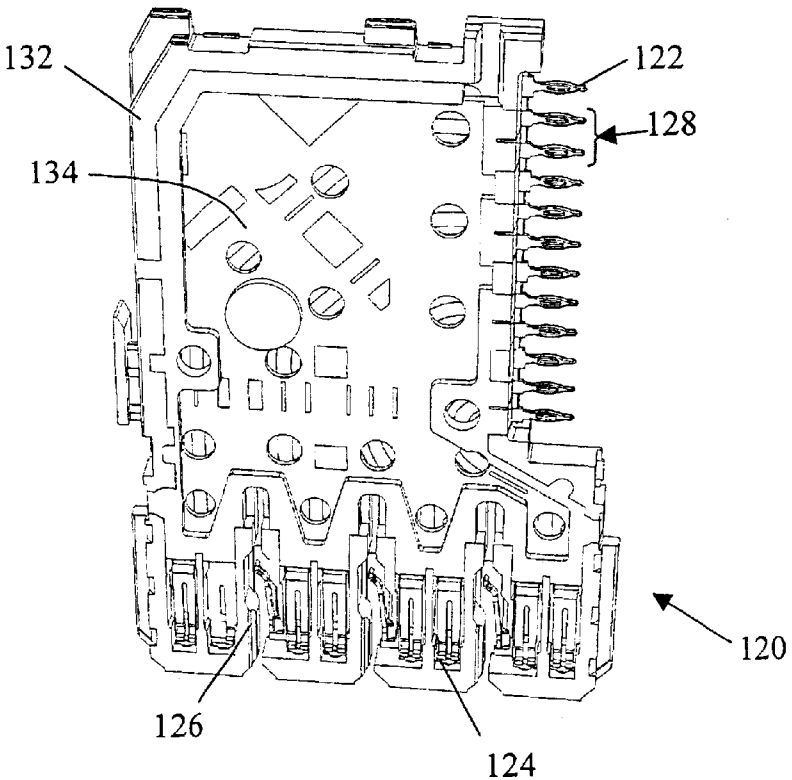
FIG. 2 (prior art)
FIG. 2 is a sketch of a wafer of the electrical connector of FIG. 1.

Referring now to FIG. 2, a single wafer is shown. Wafer 120 is shown to include dielectric housings 132, 134 which are formed around both a daughtercard shield plate (10, FIG. 3) and a signal lead frame. As described in the above-mentioned U.S. Pat. No. 6,409,543, wafer 120 is preferably formed by first molding dielectric housing 132 around the shield plate, leaving a cavity. The signal lead frame is then inserted into the cavity and dielectric housing 134 is then overmolded on the assembly to fill the cavity.

Extending from a first edge of each wafer 120 are a plurality of signal contact tails 128, which extend from the signal lead frame, and a plurality of shield contact tails 122, which extend from a first edge of the shield plate. In the example of a board to board connector, these contact tails connect the signal conductors and the shield plate to a printed circuit board. In the preferred embodiment, the plurality of shield contact tails and signal contact tails 122 and 128, respectively, on each wafer 120 are arranged in a single plane.

Here, both the signal contact tails 128 and the shield contact tails 122 are in the form of press fit "eye of the needle" compliants which are pressed into plated through holes located in a printed circuit board (not shown). In the preferred embodiment, it is intended that the signal contact tails 128 connect to signal traces on the printed circuit board and the shield contact tails connect to a ground plane in the printed circuit board. In the illustrated embodiment, the signal contact tails 128 are configured to provide a differential signal and, to that end, are arranged in pairs.

Near a second edge of each wafer 120 are mating contact regions 124 of the signal contacts which mate with the signal contacts 112 of the backplane connector 105. Here, the mating contact regions 124 are provided in the form of dual beams to mate with the blade contact end of the backplane signal contacts is 112. The mating contact regions are positioned within openings in dielectric housing 132 to protect the contacts. Openings in the mating face of the wafer allow the signal contacts 112 to also enter those openings to allow mating of the daughter card and backplane signal contacts.

Provided between the pairs of dual beam contacts 124 and also near the second edge of the wafer are shield beam contacts 126. Shield beam contacts are connected to daughter card shield plate 10 (FIG. 3) and are preferably formed from the same sheet of metal used to from the shield plate. Shield beam contacts 126 engage an upper edge of the backplane shield plate 116 when the daughter card connector 110 and backplane connector 105 are mated. In an alternate embodiment (not shown), the beam contact is provided on the backplane shield plate 116 and a blade is provided on the daughtercard shield plate between the pairs of dual beam contacts 124. Thus, the specific shape of the shield contact is not critical to the invention.

Figure 3:
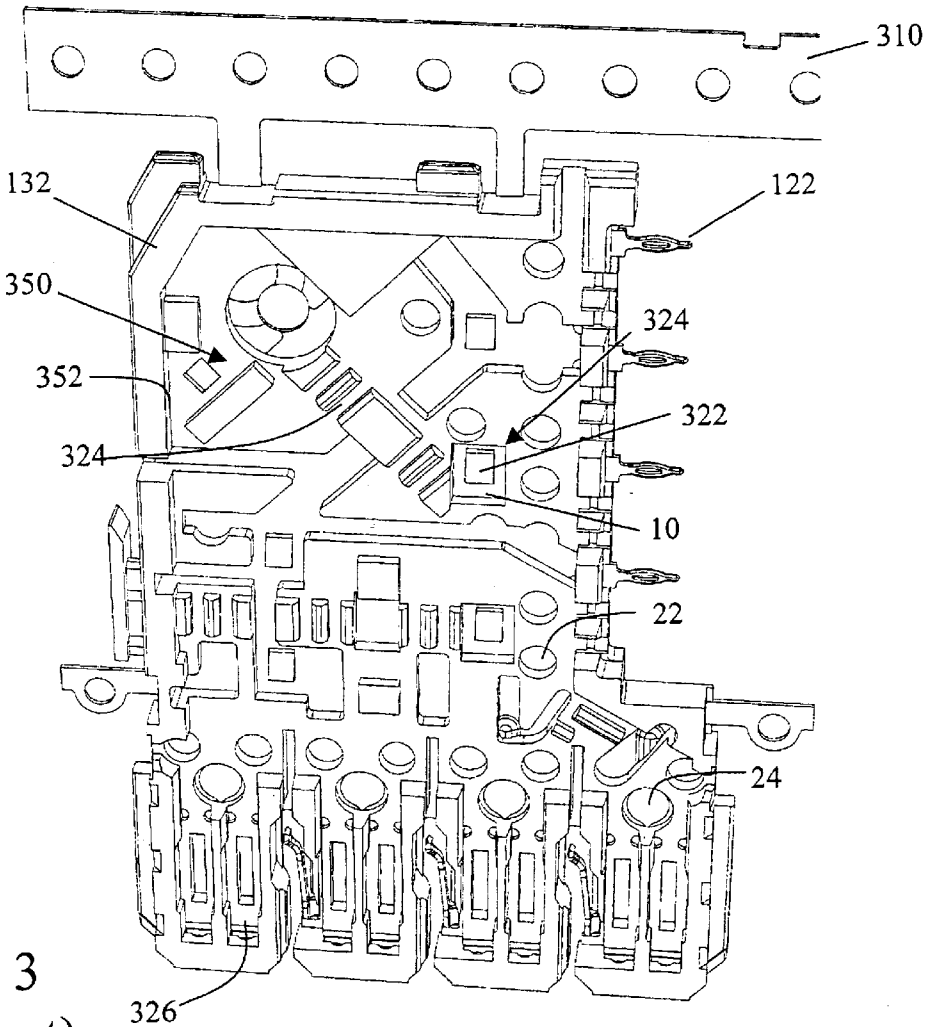
FIG. 3 (prior art)
FIG. 3 is a sketch of the wafer of FIG. 2 at a stage in its manufacture.

FIG. 3 shows a wafer at an intermediate step of manufacture. The shield plate 10 is shown still attached to a carrier strip 310. In a preferred embodiment, shield plates will be stamped for many wafers on a single sheet of metal. A portion of the strip of metal will be retained as a carrier strip. The individual components can then be more readily handled. When manufacturing is completed, the finished wafers 120 can then be severed from the carrier strip and assembled into daughter card connectors.

In FIG. 3, dielectric housing 132 is shown molded over a shield. Insert molding is known in the art and is used in the connector art to provide conductors within a dielectric housing. In this prior art connector, dielectric material is molded over the majority of the surface of shield 10. Additionally, the dielectric is largely on the upper surface of shield, leaving the lower surface of the shield exposed.

Tabs 322 on the shield plate are visible because dielectric housing 132 is molded to leave windows 324 around tabs 322. Likewise, holes 22 and 24 are visible because no dielectric housing has been molded around them.

Various features are molded into dielectric housing 132. Cavity 350 bounded by walls 352 is left generally in the central portions of the housing 132. Channels 324 are formed in the floor of cavity 350 by providing closely spaced projecting portions of dielectric housing. Channels 324 are used to position signal conductors. Also, openings 326 are molded to allow a mating contact area for each signal contact. The front face of dielectric housing 132 creates the mating face of the connector and contains holes to receive the mating contact portion from the backplane connector, as is known in the art. The walls of opening 326 protect the mating contact area.

To complete the manufacture of the prior art connector shown in FIG. 3, a signal lead frame is inserted into cavity 350. Cavity 350 is then filled with additional dielectric material to form dielectric housing 134, thereby locking the signal conductors into the wafer. Holes 22 and 24 represent openings through which stabilizers, sometimes called "pinch pins," can be inserted into the part as dielectric housing 134 is being molded. The pinch pins hold the signal lead frame in place as the part is being molded.

According to the invention, a similar molding process will be used. However, different types of material will be used in molding the housing pieces of each wafer. In particular, in addition to the dielectric material used in the prior art, a material with different electromagnetic properties is used to form a portion of the housing for the wafer. In particular, portions of the housing will be formed from material that selectively alters the electrical properties of the housing, thereby suppressing cross talk, altering the impedance of the signal conductors or otherwise imparting desirable electrical properties to the connector. In the preferred embodiment, some portion of the material used to mold the connector housing will be an insulator and some portion will have a higher conductivity.

In accordance with the preferred embodiment, prior art molding material will be used to create the portions of the connector housing that need to be non-conducting to avoid shorting out signal contacts or otherwise creating unfavorable electrical properties. Also, in the preferred embodiment, those portions of the connector housing for which no benefit is derived by using a material with different electromagnetic properties are also made from prior art molding materials, because such materials are generally less expensive and mechanically stronger than the electromagnetic materials to be described below.

Prior art electrical connector molding materials are generally made from a thermoplastic binder into which non-conducting fibers are introduced for added strength, dimensional stability and to reduce the amount of higher priced binder used. Glass fibers are typical, with a loading of about 30% by volume.

In a preferred embodiment of the invention, electromagnetic fillers are used in place of or in addition to the glass fibers for portions of the connector housing. The fillers can be conducting or can be ferroelectric, depending on the electrical properties that are desired from the material.

To simulate a metal shield insert, it is preferable that a conducting filler be used. Examples of suitable conducting fillers are stainless steel fibers, carbon fibers, nanotube material, carbon flake or nickel-graphite powder. Blends of materials might also be used.

In a preferred embodiment, the binder is loaded with conducting filler between 10% and 80% by volume. More preferably, the loading is in excess of 30% by volume. Most preferably, the conductive filler is loaded at between 40% and 60% by volume.

When fibrous filler is used, the fibers preferably have a length between 0.5 mm and 15 mm. More preferably, the length is between 3 mm and 11 mm. In one contemplated embodiment, the fiber length is between 3 mm and 8 mm.

In one contemplated embodiment, the fibrous filler has a high aspect ratio (ratio of length to width). In that embodiment, the fiber preferably has an aspect ratio in excess of 10 and more preferably in excess of 100.

Filled materials can be purchased commercially, such as materials sold under the trade name Celestran® by Ticona. Or, suitable material could be custom blended as sold by RTP Company.

Preferably, the binder material is a thermoplastic material that has a reflow temperature in excess of 250° C. and more preferably in the range of 270–280° C. LCP and PPS are examples of suitable material. In the preferred embodiment, LCP is used because it has a lower viscosity. Preferably, the binder material has a viscosity of less than 800 centipoise at its reflow temperature without fill. More preferably, the binder material has a viscosity of less than 400 centipoise at its reflow temperature without fill.

The viscosity of the molding material when filled can not be made arbitrarily high. Preferably, the material has a viscosity low enough to be molded with readily available molding machinery.

When filled, the molding material preferably has a viscosity below 2000 centipoise at its reflow temperature and more preferably a viscosity below 1500 centipoise at its reflow temperature. It should be appreciated that the viscosity of the material can be decreased during molding operation by increasing its temperature or pressure. However, binders will break down and yield poor quality parts if heated to too high a temperature. Also, commercially available machines are limited in the amount of pressure they can generate. If the viscosity in the molding machine is too high, the material injected into the mold will set before it fills all areas of the mold.

In connectors for which the conductive plastic material is molded to act as a shield, preferably, the binder is filled to provide a surface resistivity of less that $10^5$ Ω/sq. More preferably, the surface resistivity is less than $10^2$ Ω/sq. Resistivity might also be expressed as a bulk or volume resistivity. Preferably, the volume resistivity is less than 10 Ω-cm and more preferably less than 1 Ω-cm and more preferably less than 0.8 Ω-cm.

The use of plastics filled with electromagnetic materials for a portion of the connector housing allows electromagnetic interference between signal conductors to be reduced. In a preferred embodiment, housing 132 is molded with materials that contains conductive filler. If sufficiently conductive, the conductive filler acts like an extension of the shield plate 10. Even if not fully conductive, the filled plastic can absorb signals radiating from the signal conductors that would otherwise create crosstalk.

Figure 4A:
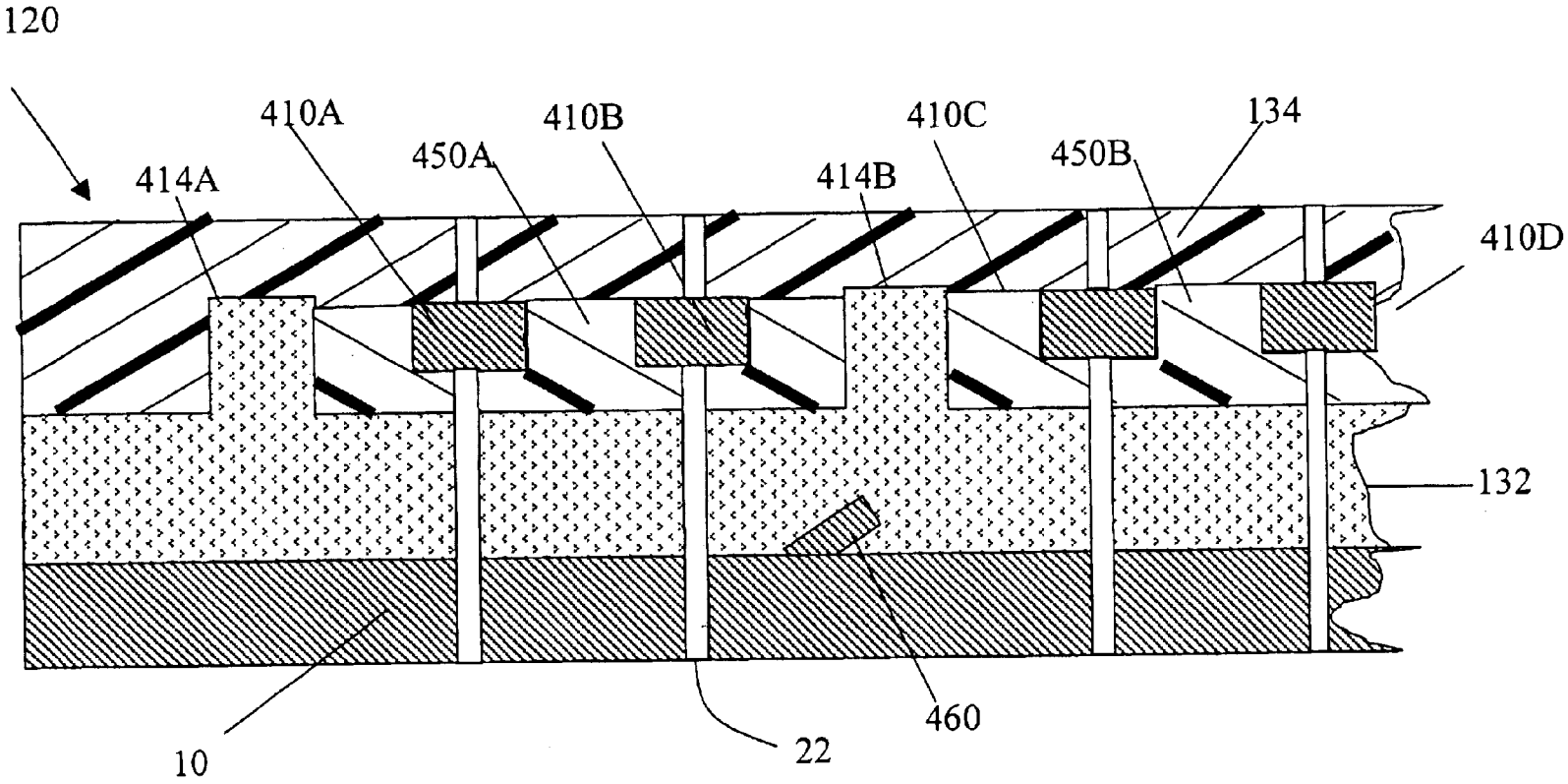
FIGS. 4A and 4B are cross sectional views of different embodiments of a wafer of an electrical connector made according to the invention.

FIG. 4 shows a portion of wafer 120 that has been molded with two types of material according to the invention. In FIG. 4A, housing 132 is shown formed from a material with conductive filler. Housing 134 is formed from an insulator with little or no conductive fillers.

Housing 132 is electrically in contact with shield 10, which will preferably be grounded in a connector system. Therefore, housing 132 is preferably grounded. To increase the electrical connection between housing 132 and shield plate 10, projections can be provided from shield plate 10. FIG. 4A shows, as an example, tab 460 bent out of the plane of shield plate 10 and projecting into housing 132.

If sufficiently conductive, housing 132 acts as an extension of shield 10. Projections 414A, 414B . . . are positioned between adjacent signal conductors used to carry different signals. They therefore provide shielding between the signal conductors. Significantly, because projections 414A, 414B . . . are molded from plastic, they can be in almost any shape and can follow the contours of the signal conductors 410A, 410B . . . through the connector.

In the embodiment of FIG. 4A, wafer 120 is designed to carry differential signals. Thus, each signal is carried by a pair of signal conductors. And, preferably, each signal conductor is closer to the other conductor in its pair than it is to a conductor in an adjacent pair. For example, a pair of signal conductors 410A and 410B carry one differential signal and signal conductors 410C and 410D carry another differential signal. Thus, projection 414B is positioned between these pairs to provide shielding between the adjacent differential signals.

Projection 414A is at the end of the column of signal conductors in wafer 120. It is not shielding adjacent signals in the same column. However, having shielding projections at the end of the row helps prevent cross-talk from column to column.

To prevent signal conductors 410A, 410B . . . from being shorted together through conductive housing 132, a second molding step is used to create insulative portions such as 450A and 450B in the housing. Once the signal conductors arc inserted, further dielectric material is molded over the part to finish housing 134.

Figure 4B:
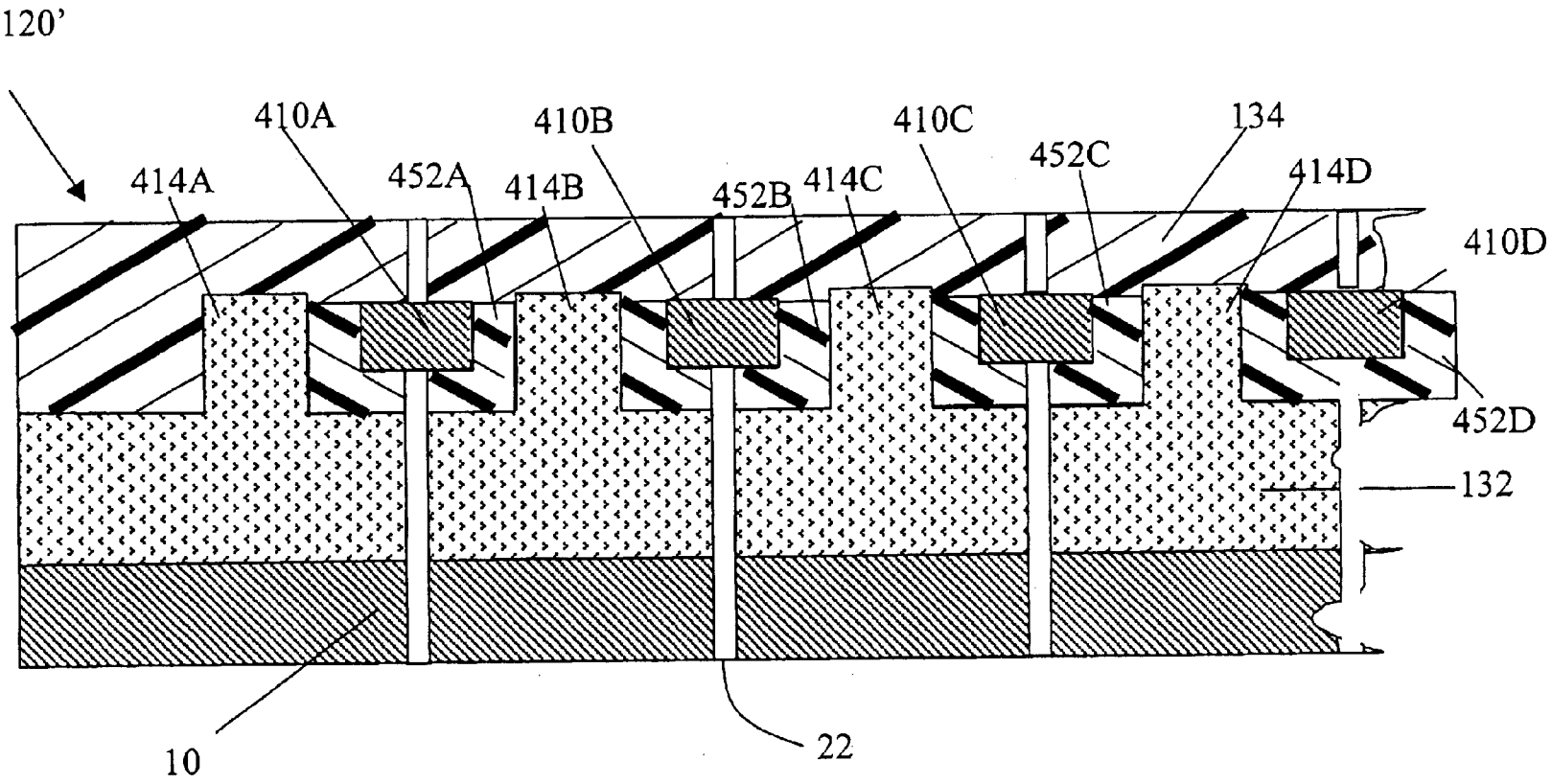

FIG. 4B shows an alternative implementation of wafer 120'. Wafer 120' is designed for single ended signals. Therefore, a projection, such as 414B, 414C, 414D . . . is positioned between adjacent signal conductors, which are relatively uniformly spaced. In FIG. 4B, insulative portions 452A, 452B . . . are molded between the projections 414B, 414C, 414D . . . to ensure that the signal conductors are not shorted to the conducting portions of the housing.

Figure 5:
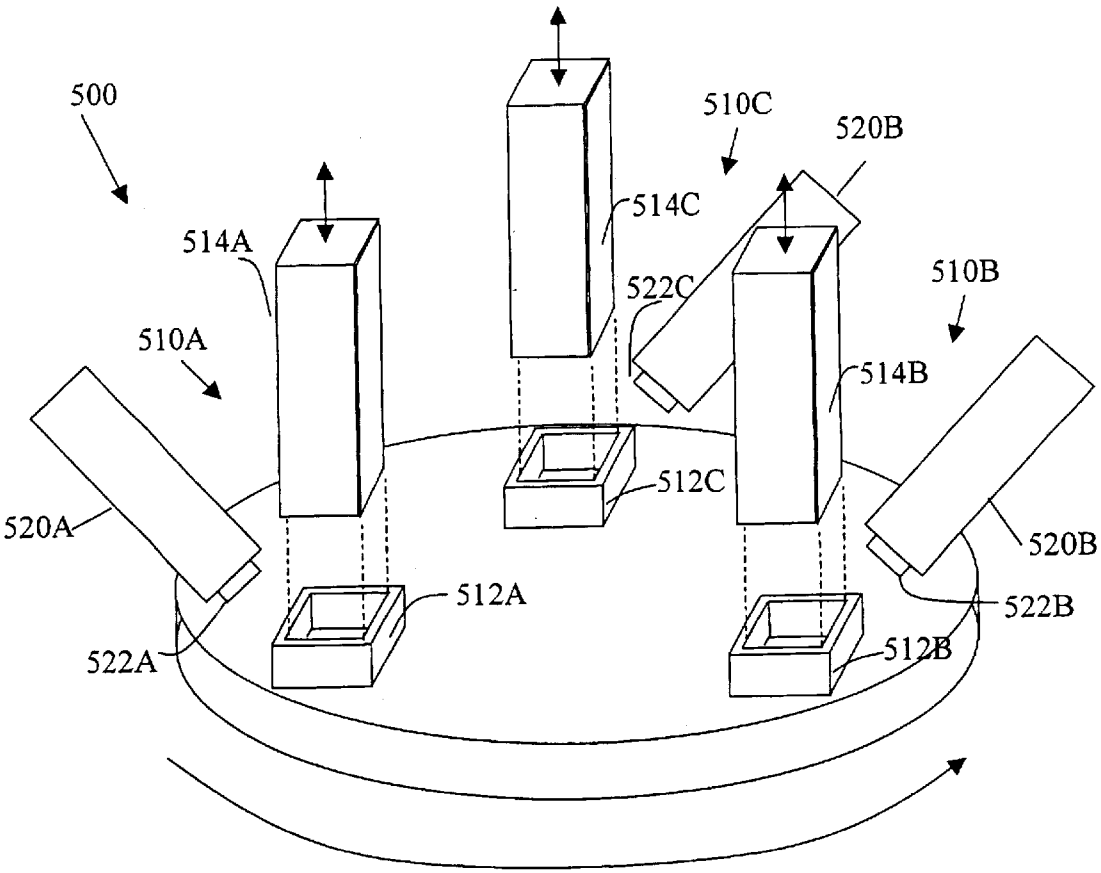
FIG. 5 is a schematic illustration of a molding machine suitable for use in making a connector according to the invention.

FIG. 5 is a simplified sketch of a machine to make a connector according to the invention. Molding machine 500 is a two-shot molding machine, generally as known in the art. Such machines arc used for things such as molding knobs, toohbrushes or buttons in two colors of plastic.

Molding machine 500 has three molding chambers 510A, 510B and 510C. Each molding chamber is made of a lower chamber, such as 512A, and an upper chamber, such as 514A. Upper chamber 514A is moveable, allowing the upper and lower chamber to separate. As is traditional in the molding art, mold pieces separate to allow removal of molded parts or to place conducting members into the chamber to prior to injection of molding material to insert mold the conducting members into the molding material.

In the illustrated embodiment, the lower chambers 512A, 512B and 512C are identical. Each lower chamber has a mold cavity that has the same contour as the lower portions of the part to be molded. Upper chamber 514A is shaped to mate with any of the lower chambers and form a mold cavity that ha contour matching the desired contour of the part being molded after one type of molding material has been applied. For example, in the case of a wafer as shown in FIG. 4, mold chamber 510A has a contour that matches shield 10 with housing 132 molded on it—but without housing 134 in place.

Mold chamber 510B has a contour that matches the upper surface of housing 132 with inserts 450A and 450B in place.

Mold chamber 510C has a contour that matches the contour of the finished part. To provide this result, upper chamber 514B will have a different shape than upper chamber 514A. In the example of FIG. 4, mold chamber 510C will have a contour that matches the contour of the finished wafer 120 with a shield 10, housing 132 and 134 in place.

Molding machine 500 includes feed systems 520A, 520B and 520C. As in a conventional molding machine, each of the feed systems provides molding material into a mold cavity. In a preferred embodiment that uses a thermoplastic material as a binder, each feed system includes a hopper of materials in pellet form.

In this preferred configuration, material is dispensed from the hopper and heated to a liquid state. The feed system then injects the liquid material into the mold cavity. For example, and auger screw can be used to provide the required force to inject the material. In FIGS. 4 5, the material passes through nozzles 522A, 522B or 522C into a respective mold chamber 510A, 510B or 510C.

In the mold cavity, the material rapidly cools to below its set point. The mold can then be opened. Parts molded in chamber 510A and 510B are only partially complete. To finish molding parts from chamber 510A, the partially finished part is left in lower chamber 512A. Lower chamber 512A is then moved below upper chamber 514B. Thus, the partially molded part is in chamber 510B. Additional material can be added to the part. The partially finished part can then be rotated below upper chamber 514C to complete the operation.

In the illustrated embodiment, lower mold chamber 512A is mounted on a moving member and moves with the partially molded part into position to form mold chamber 510B. Here, lower mold chamber 512A rotates on a turntable-like device. However, other forms of moving members could be used.

For example, a moving member that provided linear motion might be preferred. A shuttle is a suitable moving member that provides linear motion. In some cases, a shuttle-type arrangement would be preferable. Where wafers are formed on carrier strips, it is preferable that the parts move in a straight line so that a "reel to reel" manufacturing line can be set up. In such a line, numerous shield plates would be stamped from a long strip of metal. As part of the stamping, a carrier strip would be left and each of the shield plates would be attached to the carrier strip. The strip would be wound on a reel. The reel would feed shields one at a time into chamber 510A. For each cycle of the molding machine, a new shield would be fed into chamber 510A and a finished part would emerge from chamber 510B. The finished parts, still on their carrier strips, could then be wound on another reel.

In the illustrated embodiment, feed system 520A feeds molding material filled with conducting fibers. Depending on the length of fibers used in the filler and the filler content in the binder, such a material is likely to have a higher viscosity than materials traditionally used to mold connector housings. Consequently, greater pressure might be required.

Feed system 520A must generate sufficient force to inject the filled material. In practice, empirical data is gathered to determined the appropriate settings for molding machine 500. However, it is expected that the feed system providing conductor filled plastic will deliver material at a higher pressure.

Furthermore, nozzle 522A, which delivers the conductor filled plastic at higher pressure will have a larger orifice. Furthermore, the combination of higher pressure and conductive fillers, which could be abrasive, is likely to cause additional wear in feed system 520A. To counteract these problems, nozzle 522A is preferably made of a hardened material, such as carbide steel.

Other parts of molding machine 500 exposed to the conductor filled plastic are also likely to experience excessive wear and can likewise be made of hardened materials and might be made easily replaceable. For example, carbide mold inserts might be used to reduce wear and also to allow easy replacement.

Figure 6:
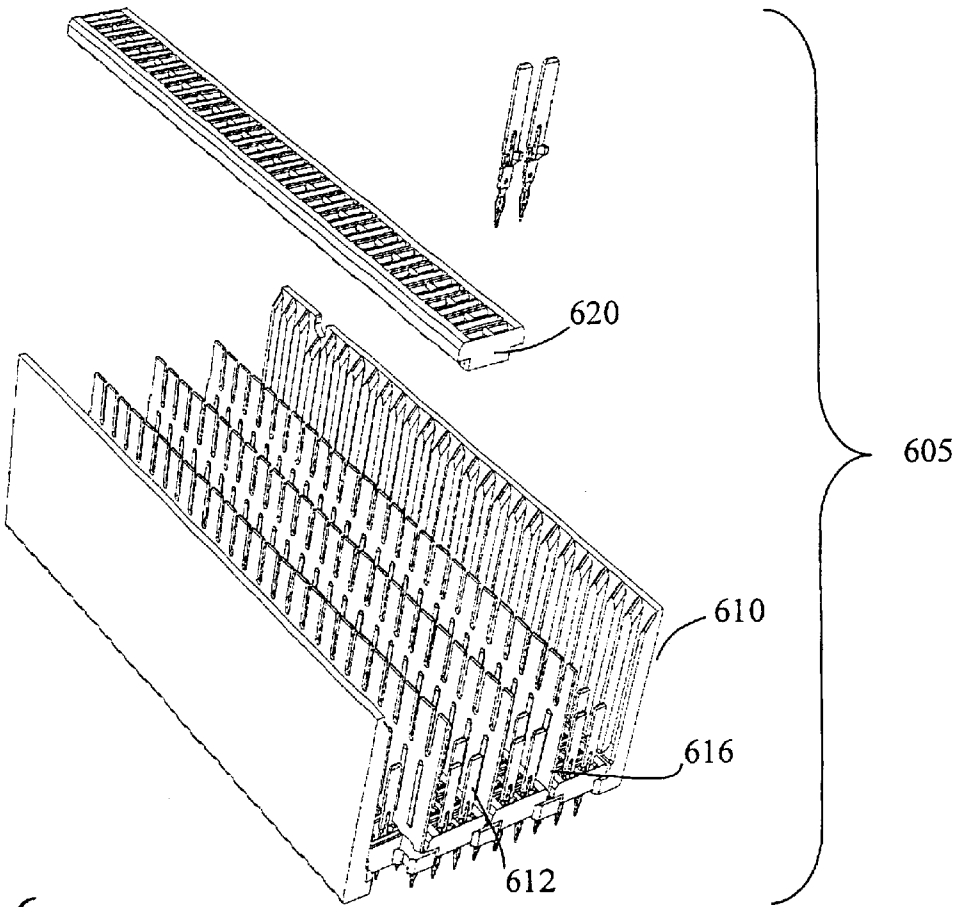
FIG. 6 (prior art)
FIG. 6 is a sketch of a prior art backplane connector.

Turing to FIGS. 6 and 7, an example of application of the invention to a backplane connector is shown. FIG. 6 shows a prior art backplane connector 605. Backplane connector 605 has a shroud 610. To enhance shielding, shroud 610 is die cast of metal.

Shields 616 may make direct electrical contact to the metal housing, as both are intended to be connected to ground in operation. However, signal conductors 612 would be shorted out if inserted directly into the metal housing. Insulative spacer member 620 is inserted into shroud 610 to prevent signal conductors 612 from being shorted out by the conducting housing of backplane connector 605.

The implementation shown in FIG. 6 has the drawback of being made of relatively expensive die cast parts and has separate pieces that add cost to the assembly operation. Using the molding technique according to the invention, a connector providing similar performance can be achieved at a lower cost.

Figure 7A:
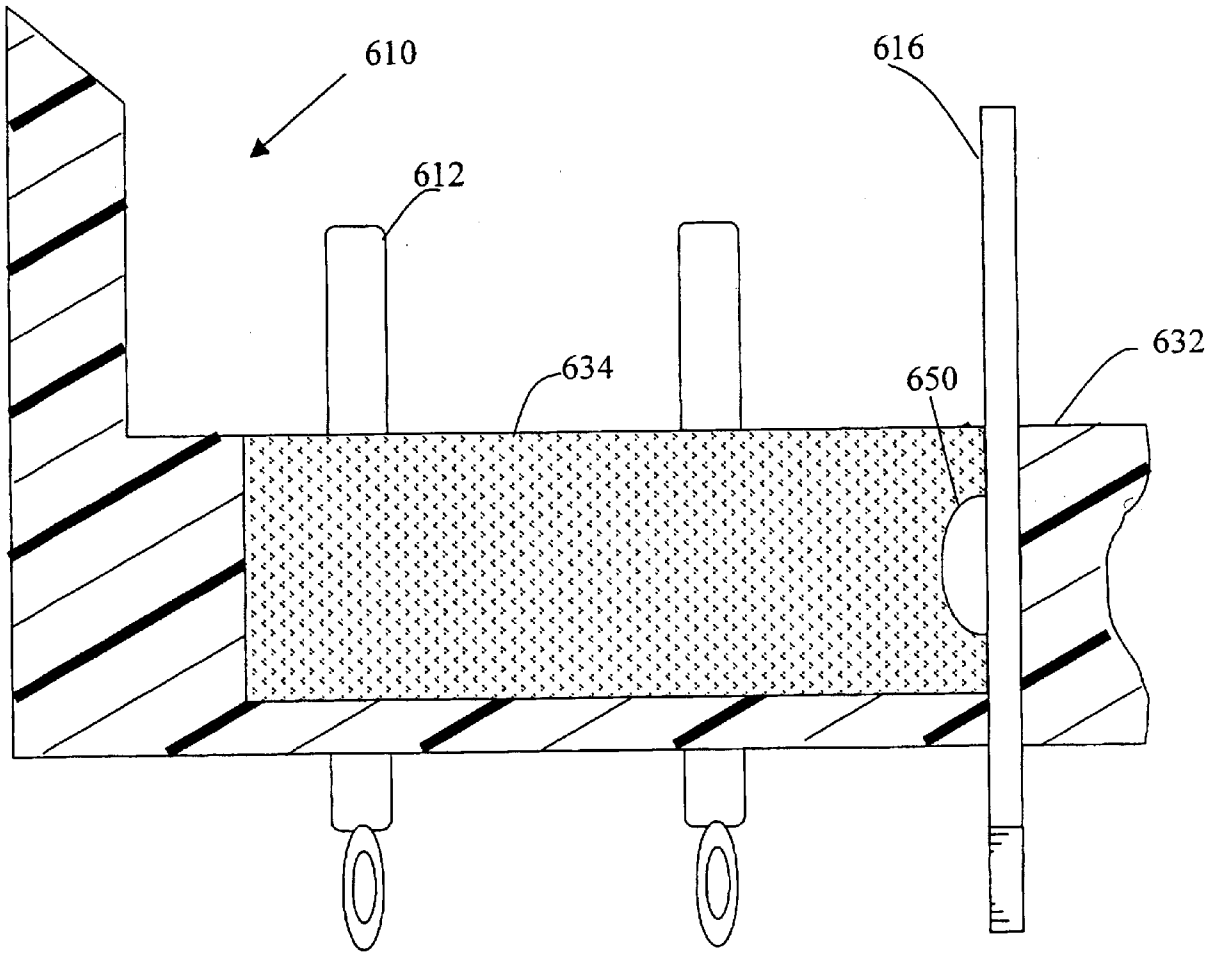
FIGS. 7A and 7B are views of a backplane connector made according to the invention.

FIG. 7A shows a portion of backplane connector 605 in cross section. Housing 632 is molded of conventional connector molding material. For example, the thermoplastic PPS filled to 30% by volume with glass fiber might be used.

In molding housing 632 a recessed area is left for housing 634. However, the recessed area includes lands 710 (FIG. 7B) that contain areas for receiving signal conductors 612.

In a second molding step, the recessed area is filled with molding material with conductive filler. Examples of the materials and fillers that might be used for housing 634 are given above.

FIG. 7A shows a projection 650 from shield 616 into the conductive portion 634. The projection enhances the electrical conductivity between the shield and the conducting plastic portions. The projection could be in any convenient form, such as a tab or a bend in the shield.

Figure 7B:
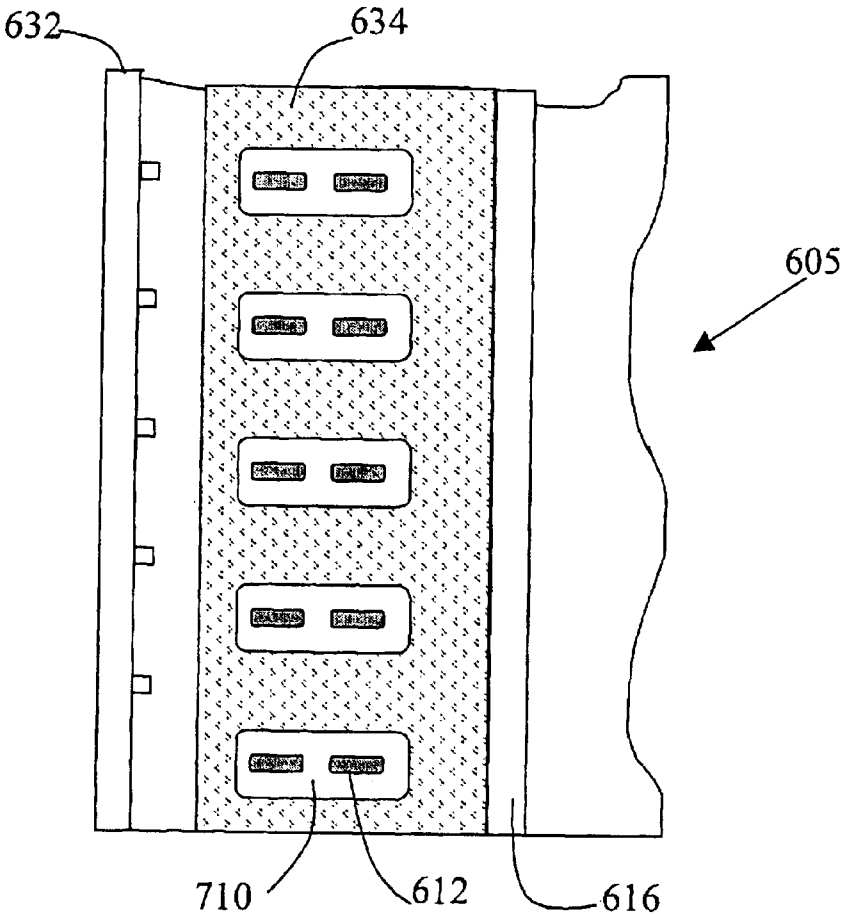

FIG. 7B shows a top view of the portion of backplane connector 605 shown in FIG. 7A. Lands 710 are visible in this view. Also, it can be seen that housing 634 is in contact with shields 616, grounding housing 634 through the ground contacts of shields 616.

Alternatives

Having described one embodiment, numerous alternative embodiments or variations can be made.

For example, it was described that parts being molded with molding material with different electrical properties are moved from molding station to molding station. It is possible that the parts could be stationary at a molding station with two different material inlets.

As another example, the invention was described as applied to a backplane-daughter card connector. Conductive features might be built into connectors in any configuration, such as stacking connectors or other board to board connectors or in phone jacks or cable connectors. Moreover, the invention was illustrated as applied to both the backplane and daughter card pieces of the connector. It could be used with either or both.

Also, a two step molding operation is described in connection with the backplane connector and a three step operation is described in connection with daughter card wafers 120. Other types of molding operations might be used. A single step molding might be used in cases where the entire housing is to be conducting. Alternatively, three or more molding steps might be performed. Such a process might be employed where the finished shape of the part is more complicated than can be molded in two steps or where materials with more than two different properties are required in the finished product.

Further, it was shown in FIG. 4A that a conductive housing is molded and then an insulative housing is molded. Thereafter, the signal contacts are inserted and a second insulative layer is applied to lock the signal contacts into place. Application of the second insulative layer could be done as a true molding operation using a mold with a cavity shaped to match the desired final contour of the part. Alternatively, a simpler form of "molding" might be used in which the first two operations leave a cavity. Once the signal contacts are inserted into this cavity the second insulative layer is "molded" by putting material into this cavity and leveling it off to leave a smooth upper surface. In this process, a full cavity mold is not required to shape the final part.

FIG. 5 shows a molding machine that has two mold chambers operating simultaneously. For each cycle of the molding machine, a part is being molded with the first type material and another part is being molded with the second type of material. One complete part can therefore emerge from mold chamber 510B each cycle. As shown, there is no loss of efficiency from having a two step molding operation. It would be possible, however, to manufacture parts with molding steps done sequentially rather than simultaneously. Sequential molding equipment might be lower cost, but would have lower throughput.

Also, it should be appreciated that preferred lengths and aspect ratios of fibers are described. It should be appreciated that all fibers in a batch will not have precisely uniform properties. Thus, when reference is made to an upper or lower limit on properties of fibers or other materials, it should be appreciated that not every fiber will meet this limit. Rather, the limits should be interpreted as meaning that most of the fibers meet that limitation.

While the invention has been particularly shown and described with reference to the preferred embodiments thereof, it will be understood by those skilled in the art that various changes in form and detail may be made therein without departing from the spirit and scope of the invention.

What is claimed is:

1. An electrical connector having electrical conductors in a plurality of rows, wherein each of the plurality of rows comprises:

a) a housing;

b) a plurality of electrical conductors, with each electrical conductor having a first contact end connectable to a printed circuit board, a second contact end and an intermediate portion therebetween that is disposed within the housing;

c) wherein the housing has:

(i) a first region surrounding each of the plurality of electrical conductors and extending substantially along the length of the intermediate portion of the electrical conductors, the first region made of insulative material; and (ii) a second region adjacent the first region and extending substantially along the length of the intermediate portion of the electrical conductors, the second region made of a material with a binder containing conductive fillers, such that the electrical conductors are electrically isolated from one another and each of the plurality of rows are shielded from adjacent rows by the second region.

2. The electrical connector of claim 1 wherein the conductive filler comprises metal fibers.

3. The electrical connector of claim 1 wherein the conductive filler comprises carbon fibers.

4. The electrical connector of claim 1 wherein the conductive filler comprises nickel-graphite powder.

5. The electrical connector of claim 1 wherein the conductive filler is present in a quantity sufficient to provide the second region with a volume resistivity less than 10 Ω-cm.

6. The electrical connector of claim 1 wherein the conductive filler is present in a quantity sufficient to provide the second region with a volume resistivity less than 1 Ω-cm.

7. The electrical connector of claim 1 wherein the conductive filler is present in a quantity sufficient to provide the second region with a volume resistivity less then 0.8 Ω-cm.

8. The electrical connectors of claim 1 wherein the conductive filler is present in a quantity sufficient to provide the second region with a surface resistivity of less than $10^5$ Ω/sq.

9. The electrical connector of claim 1 wherein the conductive filler is present in a quantity sufficient to provide the second region with a surface resistivity of less than $10^2$ Ω/sq.

10. The electrical connector of claim 1 wherein the conductive filler comprises between 10% and 80% by volume of the second region.

11. The electrical connector of claim 10 wherein the conductive filler comprises between 40% and 60% by volume of the second region.

12. The electrical connector of claim 10 wherein the conductive filler comprises in excess of 30% by volume of the second region.

13. The electrical connector of claim 1 wherein the conductive filler is a fiber having a length less than 15 mm long.

14. The electrical connector of claim 13 wherein the fiber has a length between 3 mm and 8 mm.

15. The electrical connector of claim 1 wherein the second region has a plurality of projections extending between electrical conductors disposed within the first region.

16. The electrical connector of claim 15 comprising a plurality of wafers, each having a plurality of signal conductors passing therethrough.

17. The electrical connector of claim 15 wherein the electrical connector is a backplane connector and the electrical conductors comprise blade shaped mating contact portions extending from one surface of the first region and contact tails extending from an opposite surface of the first region.

18. The electrical connector of claim 1 additionally comprising a shield member and the second region contacts the shield member.

19. The electrical connector of claim 18 wherein the shield member has a contact tail adapted for connection to a printed circuit board.

20. The electrical connector of claim 19 wherein the connector comprises a backplane shroud.

21. The electrical connector of claim 19 wherein the connector comprises a plurality of wafers, each wafer comprising a shield plate with the second region molded to the shield plate.

22. An electrical connector having a plurality of wafers, wherein each of the plurality of wafers comprises:

a) a housing;

b) a plurality of electrical conductors held within the housing;

c) wherein the housing has:

i) a first region made of insulative material and the plurality of electrical conductors pass through the first region; and ii) a second region made of a material with a binder containing conductive fillers, wherein the second region has a plurality of projections extending between electrical conductors passing through the first region.

* * * * *